United States Patent [19]

Schenke et al.

[11] Patent Number: 4,681,534

[45] Date of Patent: Jul. 21, 1987

[54] CANDLE HOLDER WITH DRAIN HOLES

[76] Inventors: Robert W. Schenke, P.O. Box 271; Reynold A. Schenke, P.O. Box 59, both of Paradise, Pa. 17562

[21] Appl. No.: 865,470

[22] Filed: May 21, 1986

[51] Int. Cl.[4] ..... F23D 3/16

[52] U.S. Cl. ..... 431/290

[58] Field of Search ..... 431/290

[56] References Cited

U.S. PATENT DOCUMENTS 3,614,279 10/1971 Schenke ..... 431/290

*Primary Examiner*—Carroll B. Dority, Jr.

*Attorney, Agent, or Firm*—Harvey B. Jacobson

[57] ABSTRACT

An upstanding tubular candle holder is provided in which to receive a consumable candle. The upper end of the tubular candle holder is tapered and defines an upper opening of a diameter slightly smaller than the diameter of the candle to be used within the holder. The interior of the holder receives a consumable candle and spring structure is provided for upwardly yieldingly biasing the candle to a position with the upper end thereof abutted against the inner surfaces of the holder disposed about the opening and with the wick of the candle projecting through the opening. The lower end of the tubular candle holder is closed and includes drain openings whereby, once the consumable candle has been removed from within the holder, hot water or other candle wax dissolving liquid may be introduced into the upper end of the tubular candle holder and drained from the lower end thereof through the drain openings in order to melt or dissolve and flush away accumulated solidified candle wax within the interior of the candle holder.

5 Claims, 5 Drawing Figures

2
48
10
12
36
20
52
18
32
26
2

48
16
14
24
22
50
12
12
20
46
44
42
40
38
3
3
36
36
52
52
4
4
28
30
30
32
32
18
18
26
34

10
12
20
40
36

36
34
10
32
32
12
52
52
20

26'
27

CANDLE HOLDER WITH DRAIN HOLES

BACKGROUND OF THE INVENTION

1. Field of the Invention

This invention relates to a tubular candle holder for a consumable candle contained within the holder and wherein the upper end of the holder includes a tapered opening against whose inner surfaces the upper end of the consumable candle is abutted through the utilization of compression spring structure supported within the lower end of the holder and yieldingly upwardly biasing the consumable candle within the holder. As the wax or other material of which the consumable candle is constructed burns away at the upper end of the candle, the latter is upwardly displaced in the holder at substantially the same rate, whereby only the burning wick of the candle will project through the open upper end opening of the holder.

However, occasionally the consumable material of which the candle is constructed will melt within the tubular holder and flow downwardly along the candle and solidify within the lower portion of the candle holder to thereby cause obstructions against the upward movement of the candle within the holder. The instant invention incorporates the provision of drain openings in the lower end of the holder whereby a heated liquid such as water may be caused to flow through the hollow holder and to exit therefrom through the drain openings for the purpose of melting and flushing away the solidified drippings of a previously burned candle without having to disassemble the plug in the lower end of the candle holder against which the compression spring for feeding the candle upwardly through the holder is abutted.

2. Description of Related Art

Various different forms of consumable candle holders heretofore have been known and which include some of the general structural and operational features of the instant invention. Examples of these previously known forms of candle holders are disclosed in U.S. Pat. Nos. 1,299,537, 1,908,044, 1,923,826, 2,464,361, 2,469,163, 3,283,546, 3,388,960 and 3,614,279. However, these previously known forms of candle holders do not include the drain openings of the instant invention whereby a heated liquid or candle material dissolving fluid may be caused to pass through the tubular candle holder for flushing accumulated solidified candle material from the interior thereof.

SUMMARY OF THE INVENTION

The instant invention resides in the provision of a plurality of drain openings in the lower end of a tubular candle holder of the type designed to fully receive a consumable candle therein with only the wick of the consumable candle projecting out of the open upper end of the holder. The drain openings enable hot water or other wax dissolving liquids to be passed through the candle holder from the upper end thereof for draining outward through the drain holes in a manner such that accumulated solidified consumable candle material may be melted or dissolved and flushed from the interior of the tubular candle holder in order to prevent a build up of such solidified candle material within the candle holder sufficient to interfere with proper operation of the upward feed of a consumable candle within the tubular candle holder.

The main object of this invention is to provide a candle holder of the tubular type for completely receiving a consumable candle therein and with the tubular candle holder including lower drain openings whereby hot water or other solidified candle material dissolving liquids may be caused to flow through the tubular holder at a rate sufficient melt or dissolve and flush accumulated solidified candle material from therewithin.

Another object of this invention is to provide a candle holder in accordance with the preceding object and which otherwise comprises a conventional tubular holder for a consumable candle.

A final object of this invention to be specifically enumerated herein is to provide a tubular candle holder in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
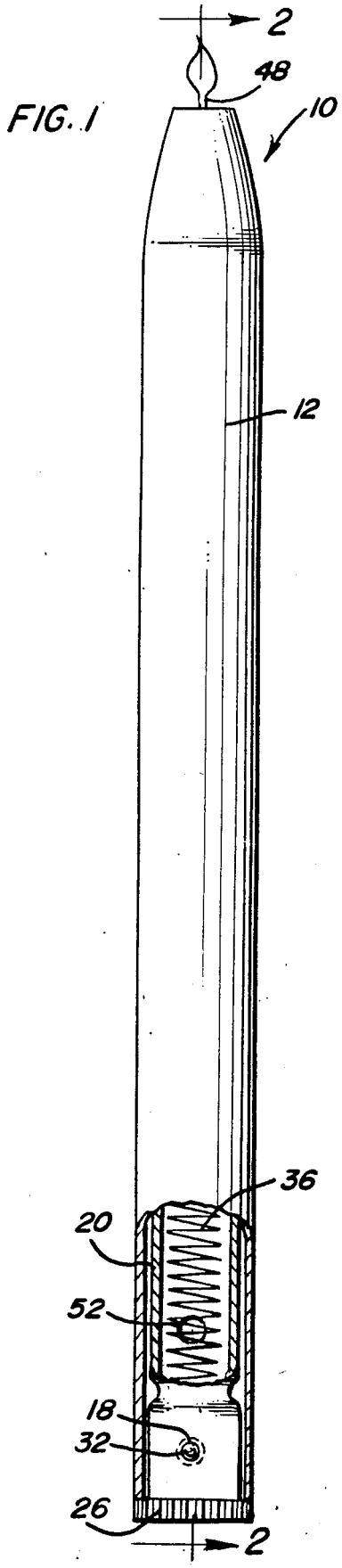
FIG. 1 is a side elevational view of a candle holder and consumable candle combination constructed in accordance with the present invention and with portions of the lower end of the candle holder being broken away and illustrated in vertical sections.
Figure 2:
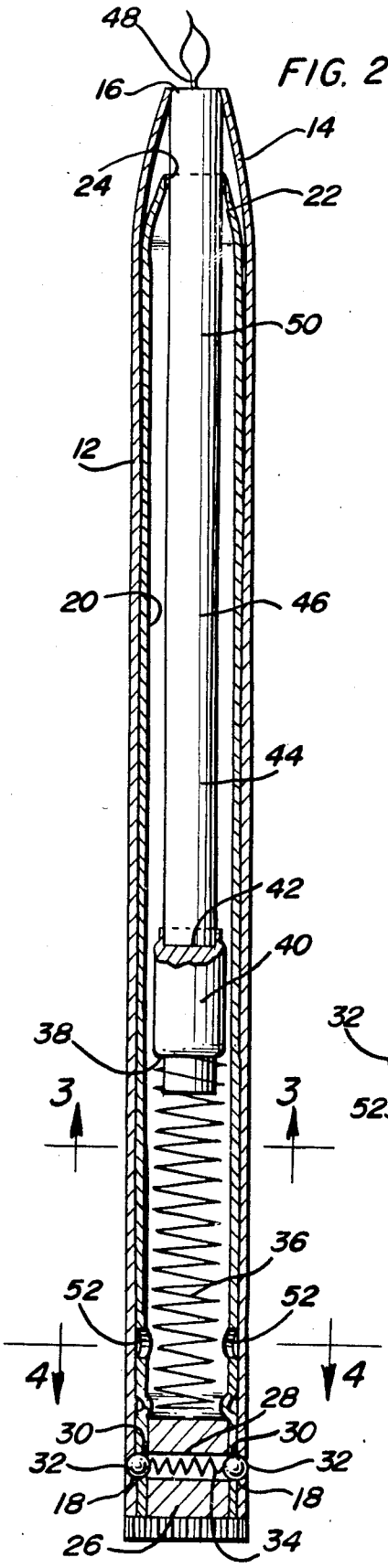
FIG. 2 is a vertical sectional view taken substantially upon the plane indicated by the section line 2—2 of FIG. 1.
Figure 3:
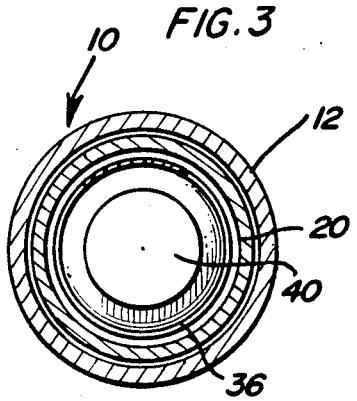
FIG. 3 is a horizontal sectional view taken substantially upon the plane indicated by the section line 3—3 of FIG. 2.
Figure 4:
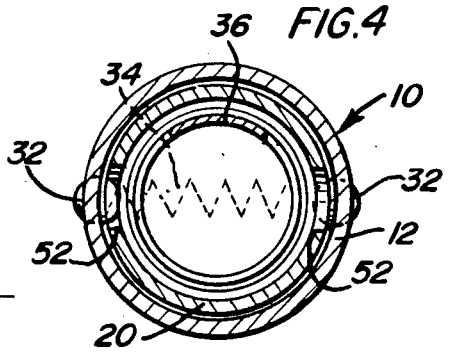
FIG. 4 is a horizontal sectional view taken substantially upon the plane indicated by the section line 4—4 of FIG. 2.

Referring now more specifically to the drawings, the numeral 10 generally designates the candle holder of the instant invention. The holder 10 includes an outer tubular member 12 having the outward shape of a candle and including a tapering upper end 14 terminating upwardly at an upper end opening 16. The open lower end portion of the outer tubular member 12 includes diametrically opposite openings 18 therein and an inner tubular member 20 is snugly and upwardly slidably received within the outer tubular member.

The inner tubular member 20 also includes a tapered upper end 22 terminating upwardly in an opening 24 which is slightly larger in diameter than the opening 16 and the lower end of the inner tubular member 20 includes a flanged plug 26 permanently secured therein and equipped with a diametric bore 28 registrable with the openings 18. The lower end of the inner tubular member 20 includes diametrically opposite openings 30 corresponding to the openings 18 and with which the opposite ends of the diametric bore 28 are registered. A pair of detent balls 32 are captively retained in the openings 30 and a compression spring 34 is disposed between the detent balls 32 and yieldingly biases the latter toward positions with the remote sides of the balls 32 received in the opening 18. In this manner, the inner tubular member 20, which is slightly shorter in length than the outer tubular member 12, is removably secured within the outer tubular member 12 with the tapered upper end 22 of the inner tubular member 20 spaced slightly below the tapered upper end 14 of the outer tubular member 12.

Furthermore, an upstanding compression spring 36 is disposed within the inner tubular member 20 above the plug 26 and has its lower end downwardly abutted against the plug 26. The upper end of the compression spring 36 is seated against a downwardly facing annular shoulder 38 formed on the lower end of a cylindrical follower 40 loosely slidably received within the inner tubular member 20 and the upper end of the follower 40 defines an upwardly opening recess 42 in which to receive the base end 44 of a consumable candle 46. The upper end of the consumable candle 46 is loosely received through the opening 24 and is abutted against the internal surfaces of the tapered upper end 14 extending about the opening 16 in a manner such that only the wick 48 of the consumable candle 46 projects through the opening 16.

The body 50 of the consumable candle 46 surrounding the wick 48 is constructed of wax or other similar material and as the wax or other similar material of the body 50 is consumed by the burning wick 48, the compression spring 36 upwardly feeds the consumable candle 46 within the tubular member 20 and tubular member 12 so as to maintain the burning end of the candle 46 at the opening 16.

However, it has been found that use of candle holders such as the holder 10 sometimes will result in melted wax from the upper end of the candle 46 flowing downwardly therealong, through the opening 24 and into a lower portion of the interior of the inner tubular member 20 so as to interfere with upward movement of the follower 40 within the inner tubular member 20 or operation of the spring 36 to yieldingly bias the follower 40 upwardly in the inner tubular member 20. When this occurs, it is necessary to remove the inner tubular member and plug 26 from the lower end of the outer tubular member 12 and to thereafter remove the candle 46 from within the inner tubular member 20. Then, attempts may be made to dislodge and shake out accumulated solidified wax build up from within the lower end of the inner tubular member 20. However, sometimes this is very difficult to achieve.

Accordingly, the lower end of the inner tubular member 20 has been provided with diametrically opposite drain openings 52 whereby a continuous stream of hot water or other suitable wax melting or dissolving liquid may be introduced into the inner tubular member 20 through the opening 24 and allowed to drain therefrom through the drain openings 52. The fluids passed through the inner tubular member in this manner soon will melt or dissolve the solidified accumulated candle wax from the interior of the inner tubular member 20 and allow the same to drain, with the fluid, from the drain openings 52. After all of the accumulated wax has been melted or dissolved and allowed to drain from the openings 52, the candle holder 10 may be reassembled.

Figure 5:
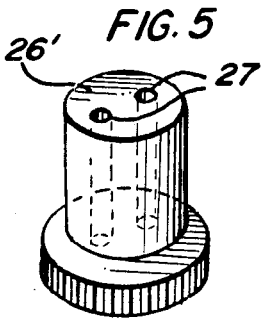
FIG. 5 is a perspective view of a candle holder lower end plug provided with drain openings and compressing a modified form of the instant invention.

With attention now invited more specifically to FIG. 5, there may be seen a modified form of plug 26' which is identical to the plug 26, but which includes a pair of opposite side longitudinal bores 27 extending completely therethrough. The axial bores 27 may be provided in lieu of the drain openings 52 and serve the same purpose.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A lifetime candle including, in combination, a permanent candle holder and a consumable candle for use with the holder, said holder including an elongated upstanding outer tubular member including an upwardly tapering upper end defining an upper end opening of a diameter slightly smaller than the diameter of said candle and an open lower end, an inner tubular member including upper and lower ends and removably mounted in said outer tubular member through the lower end thereof closing the latter and in which said candle is slidingly received, spring bias means in said inner tubular member yieldingly upwardly biasing said candle therein to a position with the upper end of said candle projecting upwardly from the upper end of said inner tubular member and abuttingly engaged with the inner surfaces of said outer tubular member upper end disposed about said opening and the wick of said candle projecting upwardly through said opening, said lower end of said inner tubular member including permanently mounted plug means closing the lower end of said inner tubular member, said inner tubular member lower end including drain opening means formed therein for draining hot water and other candle wax dissolving liquid from said inner tubular member lower end after said liquid is introduced into the upper end of said inner tubular member for dissolving and flushing away solidified wax previously collected within said inner tubular member.

2. The lifetime candle of claim 1 wherein said drain opening means includes radial drain openings formed in said inner tubular member a spaced distance above said plug means.

3. The lifetime candle of claim 1 wherein said drain opening means includes at least one longitudinally extending drain opening formed through said plug means.

4. The lifetime candle of claim 3 wherein said plug means includes a plurality of longitudinally extending drain openings formed therethrough.

5. The lifetime candle of claim 2 wherein said radial drain openings comprise diametrically opposite radial drain openings formed in said inner tubular member.

* * * * *